US005984703A

United States Patent [19]

Weingartner

[11] Patent Number: 5,984,703

[45] Date of Patent: Nov. 16, 1999

[54] PLUG-IN CONNECTION FOR ELECTRICAL LEADS

[75] Inventor: Bernhard Weingartner, Feldkirch, Austria

[73] Assignee: Neutrik Aktiengesellschaft, Schaan, Liechtenstein

[21] Appl. No.: 09/018,201

[22] Filed: Feb. 3, 1998

[30] Foreign Application Priority Data

Feb. 6, 1997 [DE] Germany ..... 197 04 437

[51] Int. Cl.[6] ..... H01R 13/53

[52] U.S. Cl. ..... 439/181; 439/544; 439/335

[58] Field of Search ..... 439/180–186, 439/296, 312, 313, 314, 332, 335, 336, 337, 338, 341, 342, 345, 544–546, 404–6, 324, 276

[56] References Cited

U.S. PATENT DOCUMENTS

| | | | |
|---|---|---|---|
| 4,659,168 | 4/1987 | Collier | 339/176 |
| 4,838,806 | 6/1989 | Igarashi | 439/341 |
| 5,370,548 | 12/1994 | Laudereau | 439/341 |
| 5,601,445 | 2/1997 | Schipper et al. | 439/341 |
| 5,785,548 | 7/1998 | Capper et al. | 439/409 |

*Primary Examiner*—Lincoln Donovan

*Attorney, Agent, or Firm*—McAulay Nissen Goldberg Kiel & Hand, LLP

[57] ABSTRACT

The electrical plug-in connector for electric leads comprises a cable plug and a chassis receptacle. The cable plug and chassis receptacle each have a housing with preferably flat contacts. The contacts of the cable plug are arranged at inner surfaces of legs of a U-shaped or frame-shaped part of the housing, which inner surfaces face one another. A wedge-shaped receiving space is cut out in the chassis receptacle for receiving this U-shaped or frame-shaped part. A nose-shaped projection is provided at one of the converging side surfaces of this receiving space, this nose-shaped projection projecting across from the other side surface. Contacts are arranged at the boundary surfaces of the latter which are disposed at right angles to the opposite side surface. The front side of this nose-shaped projection is arranged at a distance from the adjacent side surface.

15 Claims, 4 Drawing Sheets

PLUG-IN CONNECTION FOR ELECTRICAL LEADS

BACKGROUND OF THE INVENTION a) Field of the Invention

The invention is directed to an electrical plug-in connector for electrical leads, particularly having a cable plug and chassis receptacle each having a housing with preferably flat contacts which contact one another when the plug-in connection is produced.

b) Description of the Related Art

According to the currently applicable EU regulations of the so-called Low-Voltage Directive, all plug-in connectors which carry peak voltages above a certain limiting value or which can effect currents above a determined threshold load resistance must be constructed so as to protect against electrical shock. This applies particularly, for example, to plug-in connectors which connect audio power amplifiers with loudspeakers. For example, insofar as such a power amplifier is capable of delivering more than 70 Watts to a loudspeaker with an impedance of 8 Ohms, the entire connection must be constructed so as to protect against electrical shock. A connection of this kind generally comprises a chassis-type receptacle at the amplifier and loudspeaker and a cable plug at both ends of the connection cable. Power plugs are not suitable, nor are they allowed, for this purpose because of the hazard of erroneous connection.

A low-voltage signal plug connector, especially for connecting amplifiers to loudspeakers must essentially have the following characteristics:

high reliability of contact high current-carrying capacity (up to 30 A)

protected against electric shocks as currently prescribed noninterchangeable with other plug-in devices or nonreversible robust and economical enables simple and reliable locking of the cable plug in the chassis receptacle.

In this respect, reference is had to the arrangement for carrying and taking off current in installed apparatuses according to DE-PS 845 068. Current is supplied through current-conducting contact bars which are mounted so as to be isolated from one another such that they afford protection against electric shocks and are arranged in housings or strips comprising insulating material. Current is removed through springing or rigid contact faces which are arranged at the current take-off means such as handle parts, sockets or the like. The contact surfaces arranged at the current take-off means are mounted so as to be displaceable in the current-carrying contact bars. Known measures with respect to contact bars of this kind are not usable for electrical plug-in connectors and cannot be transferred to such electrical plug-in connectors.

DD-PS 141 380 further discloses a connection device for coupling with an identical connection device for an electrical connection. It comprises a frame part of insulating material which is arranged in a housing, wherein one end of the frame part is formed by a quantity of projecting fingers of electrically insulating material. Each of these fingers, with the exception of at least one, is provided, on the side facing the latter finger, with a contact member whose contact surface is smaller than the surface of the above-mentioned side. Intermediate spaces are arranged between each finger provided with a contact member and the finger toward which the contact member of such finger faces. The height of these intermediate spaces corresponds to the thickness of the fingers, so that the fingers of one connection device fit into the intermediate spaces of a complementing connection device. For this purpose, the contact members terminate at a distance from the free end of the respective finger, this distance being in a ratio to the height of the intermediate space such that the contact members cannot be touched by the user. The manner in which this connection device is to be realized in practice is not disclosed in this reference. This reference also does not show how the connection devices which are connected with one another could be mechanically locked with one another. Also, no specifics are given concerning the electrical cutoff protection whose function is to protect the current-loaded contact members from burning when the connection device is opened while carrying a current load.

U.S. Pat. No. 3,909,099 shows and describes an electrical connector with a cable clamp which is movably arranged at the connector. This cable clamp is freely pivotable in a plane containing the longitudinal axis of the cable, but is locked in its longitudinal direction. The contact elements arranged in the housing are swiveled slightly through the special support of the cable clamp during the manufacture of the electrically conducting plug-in connector. However, this reference does not point to a construction of a plug-in connector which satisfies the requirements listed above.

OBJECT AND SUMMARY OF THE INVENTION

The primary object of the invention is to provide an electrical plug-in connector which satisfies the requirements specified above and which can further be manufactured economically and is simple to assemble. The object of the invention is met in accordance with the invention by an electrical plug-in connector for electric leads, comprising a cable plug and a chassis receptacle. The cable plug and chassis receptacle each has a housing with flat contacts which contact one another when the plug-in connection is produced so as to make electrical contact. Contacts of the cable plug are arranged at inner surfaces of legs of a U-shaped or frame-shaped part of the housing of the cable plug with the inner surfaces facing one another. The chassis receptacle has a substantially wedge-shaped receiving space for receiving the U-shaped or frame-shaped part. At least one nose-shaped projection is provided at one of the converging side surfaces of the receiving space. The nose-shaped projection projects across from the other side surface. Contacts are arranged at boundary surfaces of the latter which are disposed at right angles to the opposite side surface. A front side of the nose-shaped projection is arranged at a distance from the adjacent or other side surface.

For the purpose of illustrating the invention, it is described more fully with reference to an embodiment example without the invention being limited to this embodiment example.

DESCRIPTION OF THE PREFERRED EMBODIMENTS

Figure 1:
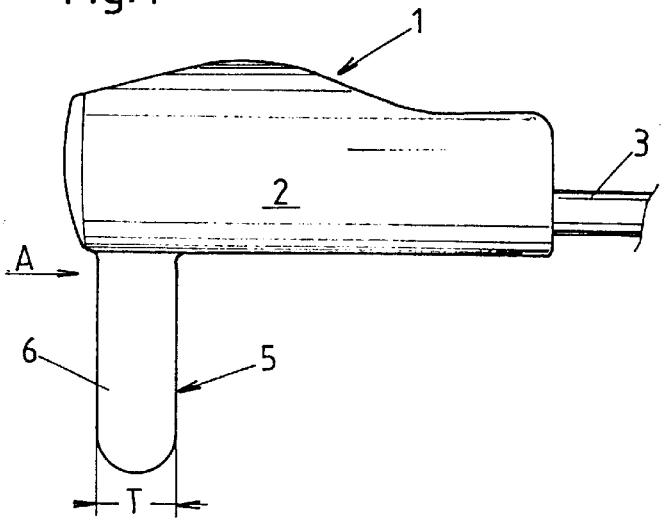
FIG. 1 shows a plan view of the cable plug.
Figure 2:
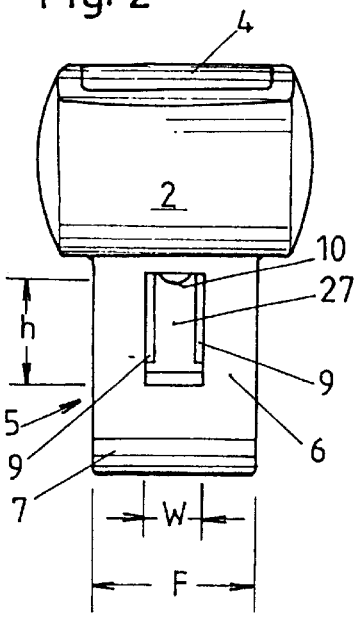
FIG. 2 is a front view of the cable plug in the viewing direction indicated by arrow A in FIG. 1.

The cable plug 1 has a housing 2 into which the cable 3 to be connected opens and in which are provided means that are suitable for the connection of this cable 3, which means are not shown here since they do not directly concern the subject matter of the invention. This housing 2 is closed by an upper cover 4 which is removed to access the means required for the connection of the cable 3. In the front region of the housing 2, that is, the side remote of the input of the cable 3, a frame-shaped part 5 with two parallel legs 6 and a web 7 connecting the free ends of these legs 6 is formed integral with the housing 2 substantially at a right angle to the longitudinal extension of the housing 2. Contacts 9 which are constructed in a flat manner, advisably so as to be slightly curved, and which are connected in an electrically conducting manner, not shown here, with the connection means in the housing 2 are provided at the inner surfaces 8 of these two legs 6, which inner surfaces 8 face one another. The web 7 of the frame-shaped part 5 joining the legs 6 which carry contacts 9 has a thickness S which is less than the thickness T of the legs 6 measured at a right angle to the plane of the frame-shaped part 5. A small protuberance 10 is formed integral with the upper frame leg, that is, on its inner side. The web 7 connecting the legs 6 carrying the contacts 9 is outwardly defined by a circular-arc-shaped boundary surface. A rectangular opening 27 is cut out through the legs 6 and the web 7 of the frame-shaped part 5.

The chassis receptacle 12, or its housing 13, has a substantially wedge-shaped receiving space 14 for the frame-shaped part 5, wherein a nose-shaped projection 17 is provided at the converging side surface 15 of this receiving space 14, this projection 17 projecting across from the other side 16. At its boundary surfaces 18 which are disposed at right angles to the opposite side surface 16 are arranged flat contacts 19 which are connected in an electrically conducting manner with the contact lugs 25 that are used for the connection of the wires. The front side 20 of this nose-shaped projection 17 is at a slight distance from the adjacent converging side surface 16. Further, laterally projecting fastening flanges 21 are provided at the housing 13, wherein the chassis receptacle 12 can be fastened by these fastening flanges 21 to a device housing, not shown.

Figure 14:
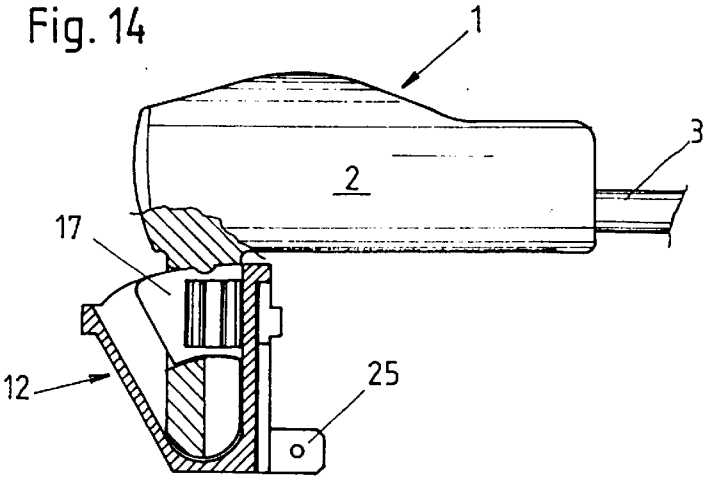
FIGS. 13 and 14 show the production of the plug-in connection in two steps, partially broken away, according to FIGS. 3 and 10.
Figure 11:
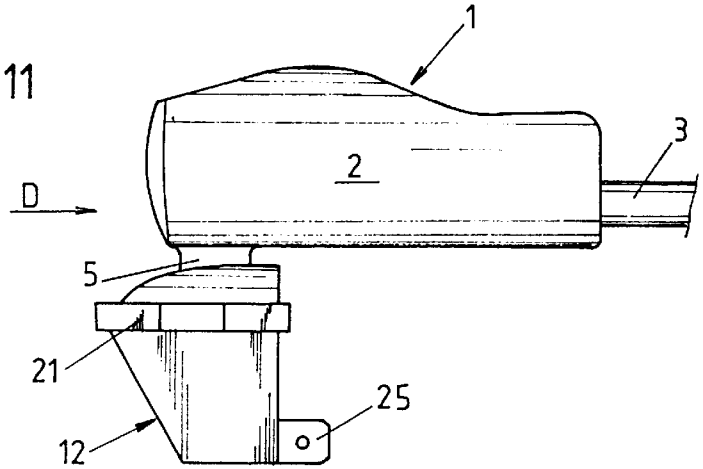
FIG. 11 is a plan view of the plug-in connection produced from the cable plug according to FIGS. 1 to 5 and from the chassis receptacle according to FIGS. 6 to 10.

The distance of the front side 20 of the nose-shaped projection 17 from the side surface 16 of the receiving space 14 located opposite to it is equal to or somewhat greater than the thickness S of the web 7 of the frame-shaped part 5. The height H of the nose-shaped projection 17 corresponds to the inner height h of the frame-shaped part 5 or the opening 27. The nose-shaped projection 17 has an upper nose ridge with a dent-like depression 22, wherein, when the plug-in connection is produced, the protuberance 10 provided at the housing 2 of the cable plug 1 engages in the dent-like depression 22 in a positive engagement as a catch (FIG. 14). The boundary surface 23 of the nose-shaped projection 17 facing the underside of the receiving space 14 of the chassis receptacle 12 extends in an arc-shaped manner. The distance E from the lower curved boundary surface 23 of the nose-shaped projection 17 to the inner base 24 of the receiving space 14 corresponds to the thickness U of the web 7 connecting the leg 6 carrying the contacts 9 as measured in the plane of the frame-shaped part 5. The converging side surfaces 15 and 16 of the receiving space 14 of the chassis receptacle 12 together enclose an angle a of approximately 30°. The width V of the nose-shaped projection 17 corresponds approximately to the distance W between two adjacent legs 6 of the frame-shaped part 5 or to the clearance or inner width of the opening 27. The inner base 24 of the receiving space 14 of the chassis receptacle 12 is constructed as a trough which is arc-shaped in cross section. The inner width of the receiving space 14, as measured at a right angle to the extension of the nose-shaped projection 17, is somewhat larger than the width F of the frame-shaped part 5. The flat contacts 19 which are secured to the nose-shaped projection 17 and which are connected with the contact lugs 25 so as to be electrically conducting are advisably slightly curved.

Figure 13:
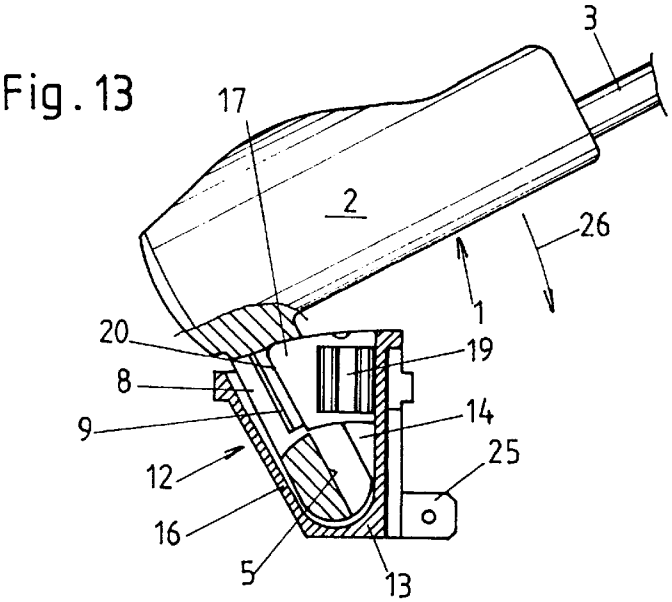
Figure 15:
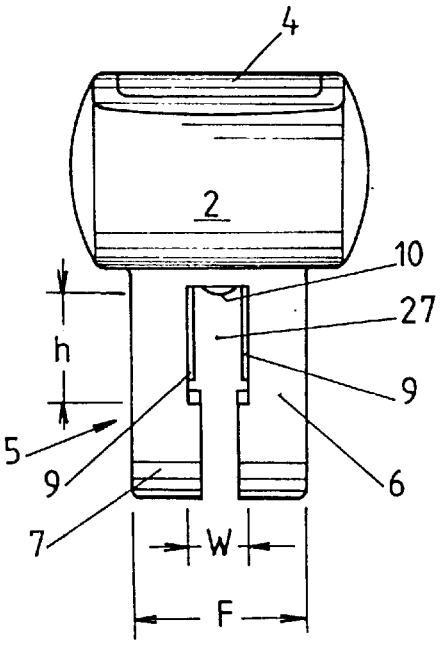
FIGS. 15 and 16 show other embodiment examples of the cable plug.

FIGS. 13 and 14 show how the contact-making plug-in connection is produced. The part 5 of the cable plug 1 which is disposed substantially at a right angle to the axis of the part of the housing 2 receiving the end of the cable to be connected is introduced into the chassis receptacle 12 between the side surface 16 and the front side 20 of the nose-shaped projection 17 which faces this side surface 16, wherein the position occupied by the two plug connector parts relative to one another corresponds to the position shown in FIG. 13. Subsequently, the cable plug 1 is swiveled in the direction of arrow 26, wherein the nose-shaped projection 17 is received by the opening 27 which is cut out of the legs 6. The contacts 9 and 19 enter into an electrically conducting connection. In so doing, the protuberance 10 catches in the dent-like depression 22 at the upper nose ridge of the projection 17. The flat contacts 9 and 19 are advisably somewhat curved so that a frictional and positive engagement is produced in addition to the produced surface contact.

The described embodiment example pertains to a two-pole or two-pin plug-in connection with contacts which are arranged so as to protect against electric shock, wherein these preferably flat contacts are arranged at complementing inner and outer surfaces of the receptacle and plug. A special advantage of the invention consists in that, in contrast to the previously known plug connectors, the plugging in process and contacting process are carried out separately, i.e., consecutively; that is, the electrical disconnection and mechanical disconnection or connection can be separated. The mechanical process substantially corresponds to a conventional plug-in process, while the electrical connection and disconnection, respectively, corresponds to a conventional switching process (breaker jack) and can be optimized in itself. A further advantage consists in that the start of the cable in the cable plug can be constructed in a very simple manner at an angle to the plug axis, wherein the cable hanging down in the locking direction assists this locking. The insertion of the cable into the cable plug is not compulsorily carried out in the axial direction of the cable plug, but rather is carried out at an angle of up to 90° relative to it. The angle at which the cable plug is introduced into the chassis receptacle diverges by at least 10°, preferably by 15°, from the common axial direction of the two plug parts during the operating state.

It can also be seen from the preceding description and explanations that the two plug parts can be locked relative to one another when changing from one direction to the other. This locking is both a positive engagement and a frictional engagement. The positive engagement is produced and canceled, respectively, by an actuating lever which is formed by the housing 2 of the cable plug. The electrical contact between the two plug parts is produced when changing from the plugged in position to the operating position.

In the embodiment example, the frame-shaped part 5 has an opening 27 and the chassis receptacle 12 has a nose-shaped projection 17. It lies within the scope of the invention to form such a frame-shaped part 5 with a plurality of legs 6 which are at a distance from and parallel to one another, so that this part 5 contains two or more openings 27, wherein contacts 9 are arranged at the inner surfaces of the legs 6. Corresponding to the quantity of these openings 27, nose-shaped projections 17 with contacts 19 are provided in the chassis receptacle 12.

In the described embodiment example, the thickness S of the web 7 at the cable plug 1 in connection with the distance between the side surface 16 and the front side 20 of the nose-shaped projection 17 at the chassis receptacle 12 ensures that the two plug parts can only be put together in a given position (FIG. 13). As was already mentioned, the frame-shaped part has a plurality of openings 27. These openings 27 can have different widths W, if required, wherein the thickness V of the projections 17 provided at the chassis receptacle 12 is configured so as to correspond to and complement these widths W, so that it can also be ensured that the two plug parts can be put together only in a predetermined position relative to one another.

In the embodiment example of the cable plug 1 described above, the part 5 is constructed as a circumferentially closed frame. It lies within the scope of the invention to construct this part in a U-shaped manner as is shown in Fig, 15, wherein the free ends of the legs 6 have portions which are directed against one another in order to achieve the required positive engagement when carrying out the contact-making connection with the chassis receptacle 12.

Figure 3:
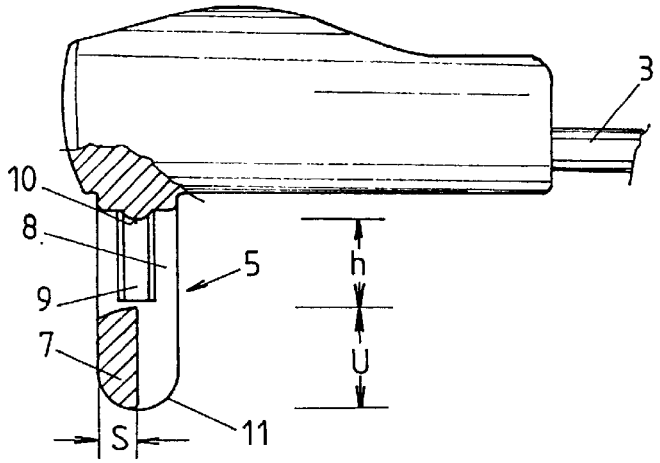
FIG. 3 is a plan view of the cable plug, partially broken away.
Figure 5:
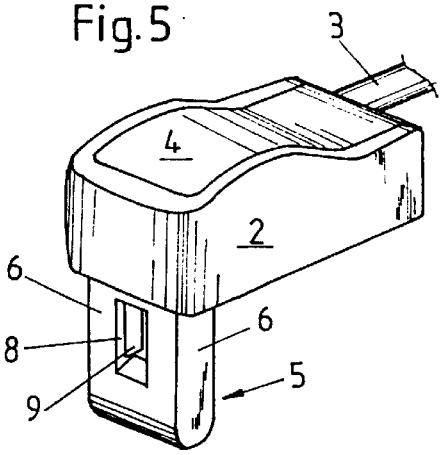
FIG. 5 is an oblique view of the cable plug.
Figure 4:
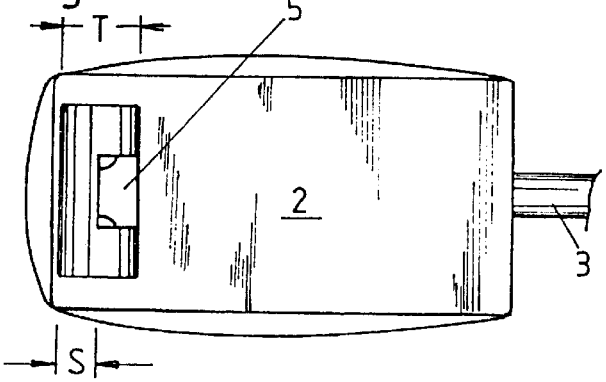
FIG. 4 is a bottom view of the cable plug.
Figure 6:
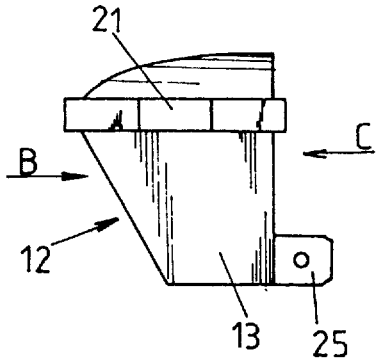
FIG. 6 is a plan view of the chassis receptacle.
Figure 7:
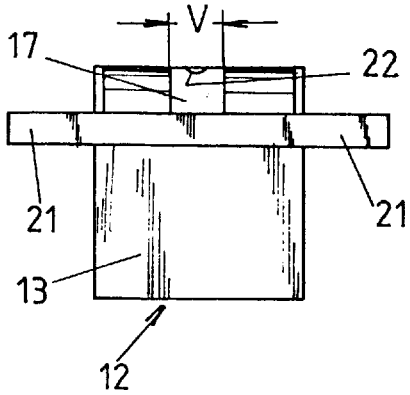
FIG. 7 is a front view of the chassis receptacle in the viewing direction indicated by arrow B in FIG. 6.
Figure 8:
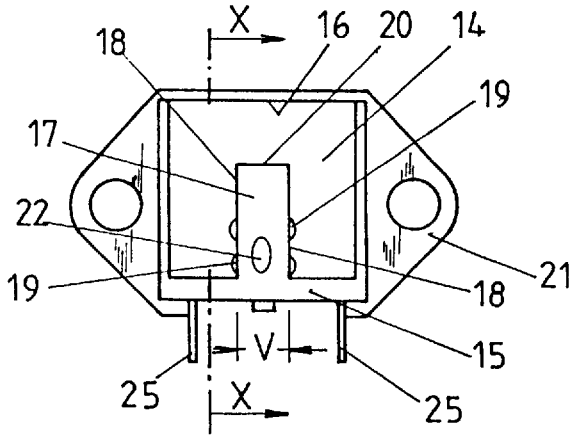
FIG. 8 shows a top view of the chassis receptacle.
Figure 10:
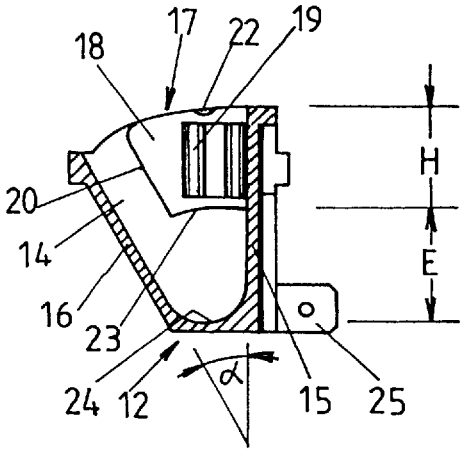
FIG. 10 is a cross-sectional view of the chassis receptacle according to line X—X in FIG. 8.
Figure 9:
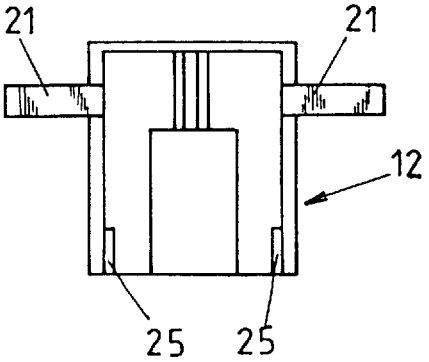
FIG. 9 shows a rear view of the chassis receptacle in the viewing direction indicated by arrow C in FIG. 6.
Figure 12:
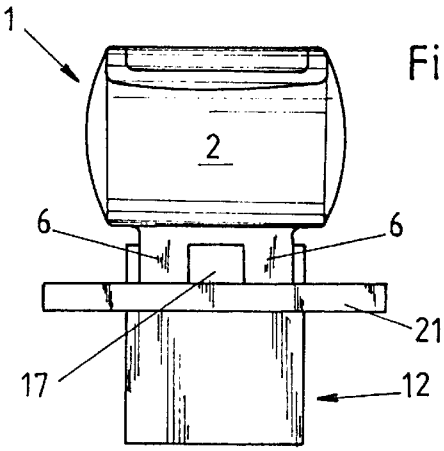
FIG. 12 shows the plug-in connection according to FIG. 11 in a front view as seen in the viewing direction according to arrow D in FIG. 11.
Figure 16:
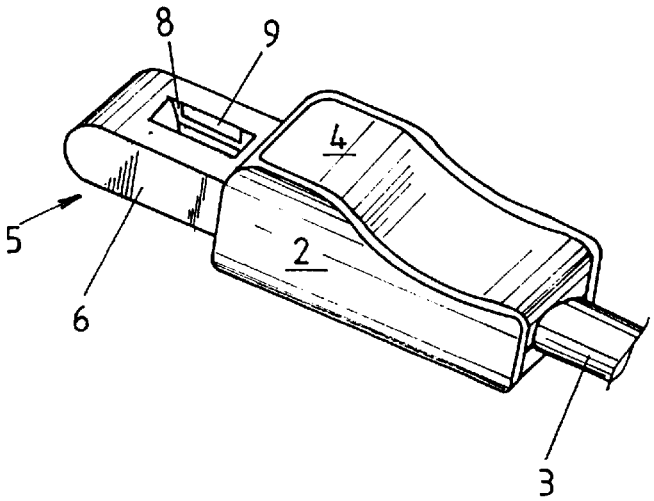

Further, in the cable plug 1 described in the introduction, its housing 2 and part 5 are arranged substantially at a right angle to one another (FIG. 1 and FIG. 3). As is illustrated in FIG. 16, these two parts, namely the housing 2 and part 5, can also be connected with one another in an aligned arrangement.

While the foregoing description and drawings represent the preferred embodiments of the present invention, it will be obvious to those skilled in the art that various changes and modifications may be made therein without departing from the true spirit and scope of the present invention.

What is claimed is:

1. An electrical plug-in connector for electric leads, comprising:

a cable plug and a chassis receptacle adapted to receive said cable plug;

said cable plug and chassis receptacle each having a housing with flat contacts which contact one another when the cable plug is received by the chassis receptacle;

the contacts of said cable plug being arranged at inner surfaces of legs of a U-shaped or frame-shaped part of said housing of said cable plug with said inner surfaces facing one another;

said chassis receptacle having a wedge-shaped receiving space for receiving said U-shaped or frame-shaped part;

at least one nose-shaped projection being provided at one converging side surface of said receiving space;

said nose-shaped projection projecting partially across from said one converging side surface to a surface opposite to said one converging side surface;

the contacts of said chassis receptacle being arranged at boundary surfaces of the nose-shaped projection which are disposed at right angles to said converging side surface.

2. The electrical plug-in connector according to claim 1, wherein the U-shaped or frame-shaped part lies in a plane and wherein a web of the U-shaped or frame-shaped part joining the legs which carry contacts has a thickness which is less than the thickness of the legs measured at a right angle to the plane of the U-shaped or frame-shaped part.

3. The electrical plug-in connector according to claim 1, wherein the thickness of the web is equal to, or somewhat less than, the distance of the front side of the nose-shaped projection from the side surface of the chassis receptacle located opposite to it.

4. The electrical plug-in connector according to claim 1, wherein the height of the nose-shaped projection corresponds to the inner height of the U-shaped or frame-shaped part.

5. The electrical plug-in connector according to claim 1, wherein the nose-shaped projection has an upper nose ridge with a dent-like depression, wherein, when the plug-in connection is produced, a protuberance provided at the housing of the cable plug engages in the dent-like depression in a positive engagement as a catch.

6. The electrical plug-in connector according to claim 1, wherein the boundary surface of the nose-shaped projection facing the underside of the receiving space of the chassis receptacle extends in a curved manner.

7. The electrical plug-in connector according to claim 6, wherein the distance of the lower curved boundary surface of the nose-shaped projection from the inner base of the receiving space corresponds to the thickness of the web connecting the legs carrying the contacts, which thickness is measured in the plane of the U-shaped or frame-shaped part.

8. The electrical plug-in connector according to claim 1, wherein the U-shaped or framed-shaped part lies in a plane and wherein the plane of the U-shaped or frame-shaped part lies parallel to the axis of the part of the housing of the cable plug receiving the end of the cable to be connected.

9. The electrical plug-in connector according to claim 1, wherein the U-shaped or framed-shaped part lies in a plane and wherein the plane of the U-shaped or frame-shaped part encloses an angle with the axis of the part of the housing of the cable plug receiving the end of the cable to be connected.

10. The electrical plug-in connector according to claim 9, wherein the U-shaped or framed-shaped part lies in a plane and wherein the plane of the U-shaped or frame-shaped part lies substantially at a right angle to the axis of the part of the housing of the cable plug receiving the end of the cable to be connected.

11. The electrical plug-in connector according to claim 1, wherein the converging side surfaces of the receiving space of the chassis receptacle together enclose an angle ($\alpha$) of approximately 30°.

12. The electrical plug-in connector according to claim 1, wherein the width of the nose-shaped projection corresponds approximately to the distance between two adjacent legs of the U-shaped or frame-shaped part of the cable plug.

13. The electrical plug-in connector according to claim 2, wherein the web connecting the legs carrying the contacts is outwardly defined by a circular-arc-shaped boundary surface.

14. The electrical plug-in connector according to claim 7, wherein the inner base of the receiving space of the chassis receptacle is constructed as a trough which is arc-shaped in cross section.

15. The electrical plug-in connector according to claim 1, wherein the U-shaped or frame-shaped part of the cable plug has three or more legs which are arranged parallel to one another and carry contacts at their respective inner surfaces, which inner surfaces face one another, and the chassis receptacle has nose-shaped projections with contacts corresponding to the quantity of openings which are cut out of these legs.

* * * * *